United States Patent [19]

Ringe

[11] 4,232,891

[45] Nov. 11, 1980

[54] DOOR HARDWARE WITH POSITIVE TORQUE

[75] Inventor: Stephen J. Ringe, Detroit, Mich.

[73] Assignee: Fruehauf Corporation, Detroit, Mich.

[21] Appl. No.: 910,493

[22] Filed: May 30, 1978

[51] Int. Cl.[3] ..... E05C 3/04

[52] U.S. Cl. ..... 292/218

[58] Field of Search ..... 292/241, 218, 342, 240, 292/242

[56] References Cited

U.S. PATENT DOCUMENTS

| | | | |
|---|---|---|---|
| 1,466,528 | 8/1923 | Holmes | 292/241 |
| 1,772,177 | 8/1930 | Dake | 292/241 X |
| 3,039,837 | 6/1962 | Poe | 292/241 X |
| 3,806,173 | 4/1974 | Sweda | 292/218 X |
| 4,029,349 | 6/1977 | Sweda et al. | 292/218 X |

*Primary Examiner*—Richard E. Moore

[57] ABSTRACT

A hollow keeper housing is secured to the header or sill of a door of a truck trailer for receiving a generally arcuate camming finger disposed at the end of a rotatable vertical lock rod. The camming finger and keeper housing are designed so that when force is applied against a latched door, a relatively flat surface of the camming finger is tangent with the inner camming surface of the hollow keeper housing at a point located a distance from a plane parallel to the line of force and passing through the axis of rotation of the lock rod, the distance providing a torque in a latching direction.

5 Claims, 7 Drawing Figures

DOOR HARDWARE WITH POSITIVE TORQUE

BACKGROUND AND SUMMARY OF THE INVENTION

The present invention relates to the field of latching mechanisms for doors of truck trailers, containers, freight cars and the like. More specifically, this invention relates to such latching mechanisms wherein a generally arcuate camming member is disposed at each end of a rotatable vertical lock rod which extends above and below the edges of the door. Each of the cam members is adapted to engage a keeper mounted on the door sill or header.

Latches of this general description are known and are shown, for example, in British Pat. No. 1,249,311, Oct. 13, 1971 to Blair Products S. A., and in U.S. Pat. No. 3,989,289, Nov. 2, 1976 to Ringe; 3,806,173, Apr. 23, 1974 to Sweda; 3,801,146, Apr. 2, 1974 to Donath et al; and 3,134,618, May 26, 1964 to Heimann.

The present invention relates to an improved latching mechanism which is designed so that a positive, or locking moment is applied to cam members on a rotatable lock rod when the cam members are in a closed or locked position in keepers and force is applied outwardly to the door. Outward force might be applied to the door, for example, as the result of a shifting load. Thus, a force against the interior of the door and in an outward or door-opening direction, will tend to rotate each cam member and lock rod in a direction which maintains the cam member in a closed or secured position in the keeper housing. It would also be desirable if the cam member, when in a closed or locked position, would span the interior of the hollow keeper housing to limit racking displacement and outward movement of the door.

Hence, it is an object of the present invention to provide a latching mechanism having a positive torque, i.e. a moment in a locking direction, in response to force applied against the door in an outward direction. It is another object of this invention to provide a latching mechanism which can be adapted to limit racking movement. Yet another object of this invention is to provide a latching mechanism which can be adapted to limit inward and outward door play or movement when the latch is closed. Still another object of this invention is to provide a lock rod having a camming member with positive torque in the closed position but can be used to cam the door closed or open by an operator rotating the lock rod.

These and other objects are achieved by the present invention which includes a camming member disposed at each end of a rotatable lock rod extending vertically above and below the edges of a door of a trailer or container. The camming member has a generally arcuate camming finger which is received within a hollow keeper housing secured to the header or sill. When moving to a closed position, a generally concave inner camming surface of the camming finger engages a camming surface interior of the hollow keeper housing. When closed, the point of tangency of the hollow keeper housing and the generally concave inner camming surface of the camming finger is at a relatively planar portion thereof and at a point such that the line of force resulting from a force against the door in a door opening direction is a distance from the plane parallel thereto and passing through the axis of rotation of the lock rod such that a moment is applied to said rod in a locking direction. The camming member can have an extended back and an extended heel to span the interior of the hollow keeper housing and thereby limit play or movement of the camming member when in the closed position.

DESCRIPTION OF THE PREFERRED EMBODIMENTS

Figure 5:
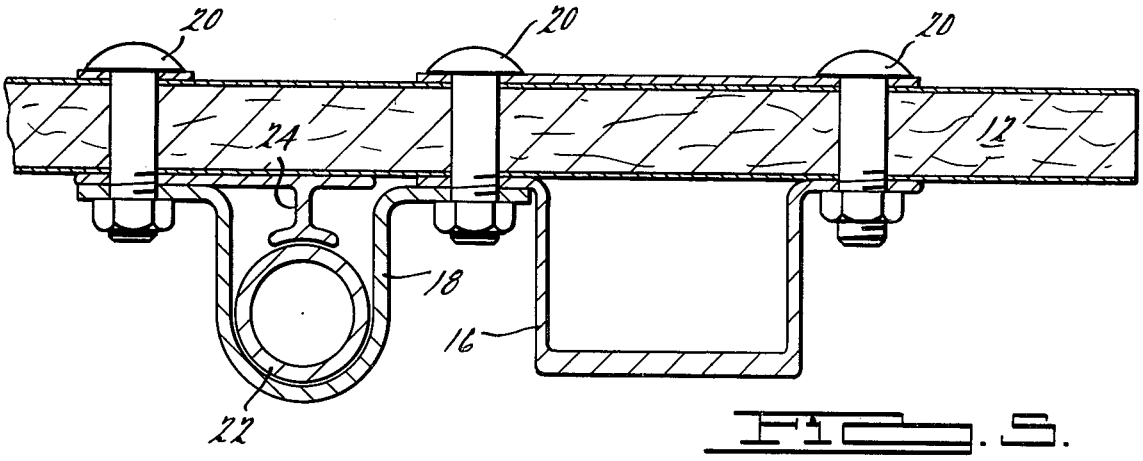
FIG. 5 is an enlarged fragmentary sectional view taken along the line 5—5 of FIG. 1 and illustrating a rotatable lock rod and door bracket therefor.

Now referring to the drawing, a truck trailer 10 has a door 12 secured to the rear open end by a plurality of hinges 14. Door 12 has a double-bent stiffening rib member 16 attached to the outer face of door 12 near its free edge and extending the full height of the door. Door 12 also has a plurality of brackets 18 secured to its outer face adjacent to rib member 16. Both rib members 16 and brackets 18 are secured to door 12 by a plurality of bolts 20 or other suitable fasteners. Brackets 18 have an elongated channel shape of generally U-shaped cross-section and are adapted to rotatably secure lock rod 22. As shown best in FIG. 5, lock rod 22 is located in bracket 18 by a plurality of spacers 24 which limit inward movement of lock rod 22 but allow rotation thereof.

Figure 1:
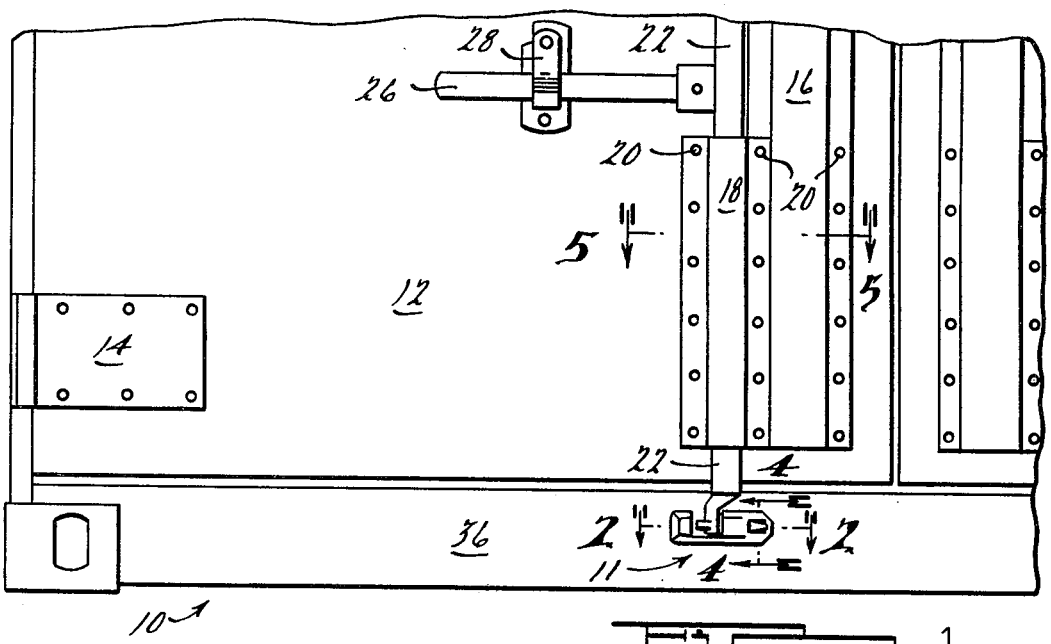
FIG. 1 is a view in elevation and broken away of the rear face of a truck trailer having door hardware of the present invention thereon.

An operating handle 26 is pivotally mounted on lock rod 22 for vertical movement so that it can be engaged and secured within locking bracket 28 in a conventional manner. As indicated at 11 on FIG. 1, the lower end of lock rod 22 has fixedly attached thereto, by welding or other means, a camming member 30 having a camming finger 32. Keeper housing 34 is secured to bottom sill 36 of truck trailer 10 and has an opening 38 and an opening 39 therein communicating with its hollow interior 40. Camming finger 32 is aligned with opening 38 when extended theretoward. Keeper housing 34 has an inwardly extending camming surface 42 formed by protuberance 44.

Camming member 30 has a camming finger 32 and a heel 46 and back 48 each of sufficient size to be in spanning relationship to bottom sill 36 of trailer 10 and heel stop 50 of keeper housing 34 respectively. It will, of course, be appreciated by those skilled in the art that in a conventional installation camming members 30 will be fixedly attached in aligned relationship with each other at each end of lock rod 22 and keeper housings 32 will be secured to the top portion or header of truck trailer 10 and bottom sill 36, each keeper housing 34 being adapted to receive a camming finger 32.

Figure 2:
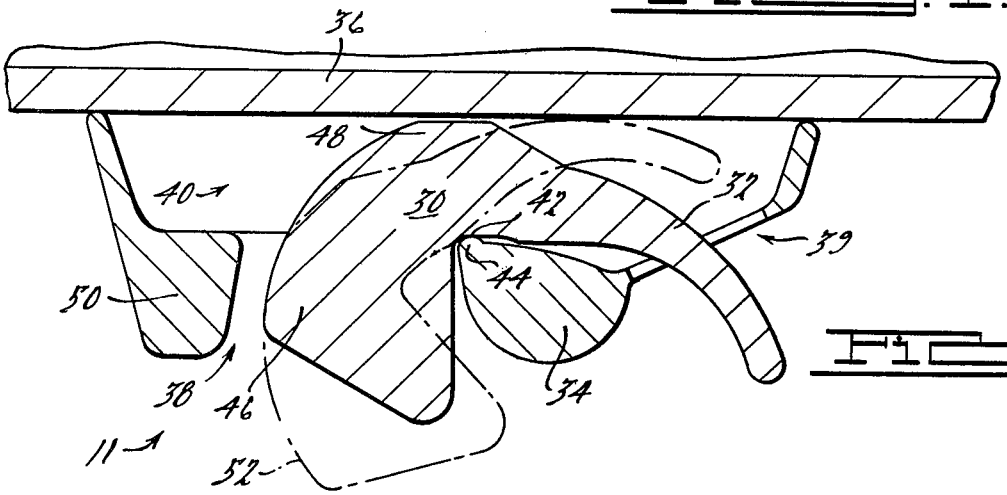
FIG. 2 is an enlarged broken sectional view taken along the line 2—2 of FIG. 1 and illustrating a hollow keeper housing of the present invention and a camming finger in locked and opening/closing relationships therewith.
Figure 3:
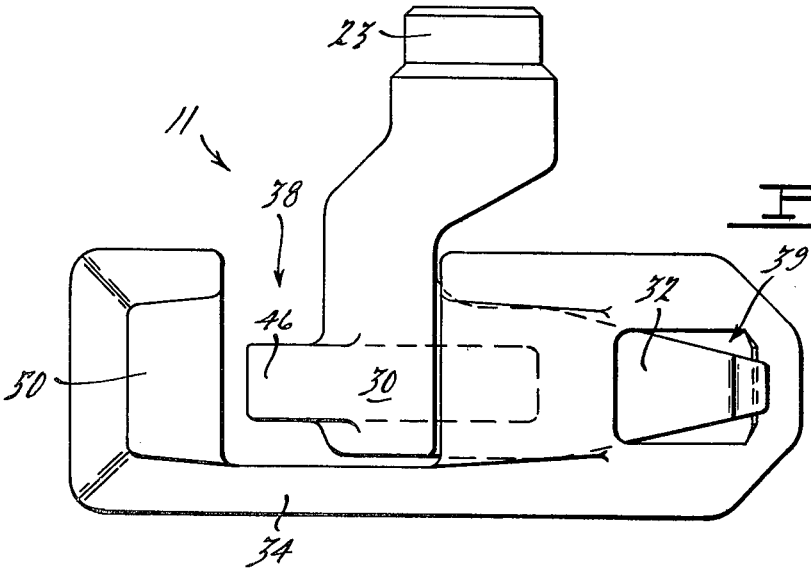
FIG. 3 is an enlarged elevational view of the hollow keeper housing and camming finger structure shown in FIG. 2.

When door 12 is to be closed, camming finger 32 is inserted into opening 38 in keeper housing 34 and lock rod 24 is rotated by the operator moving operating handle 26 towards door 12 thereby urging camming finger 32 against camming surface 42 of keeper housing 34 to cam door 12 to a closed position. Thus, as shown in FIG. 2, camming finger 32 advances through position 52, shown in broken lines, to the closed position shown in full lines.

When camming finger 32 is in the closed position, it should be noted that back 48 is proximate to bottom sill 36 and hence camming member 30 substantially spans the distance between camming surface 42 of keeper housing 34 and bottom sill 36 thus limiting inward and outward movement of lock rod 22 and door 12. Also, in the closed position heel 46 is proximate to heel stop 50 of keeper housing 34 and, hence, acts to limit racking or lateral movement resulting from the effect of uneven road surfaces on the trailer geometry. It will be understood that the function of heel stop 50 can also be served by a heel stop suitably located on bottom sill 36 and not integrally formed with keeper housing 34.

Figure 6:
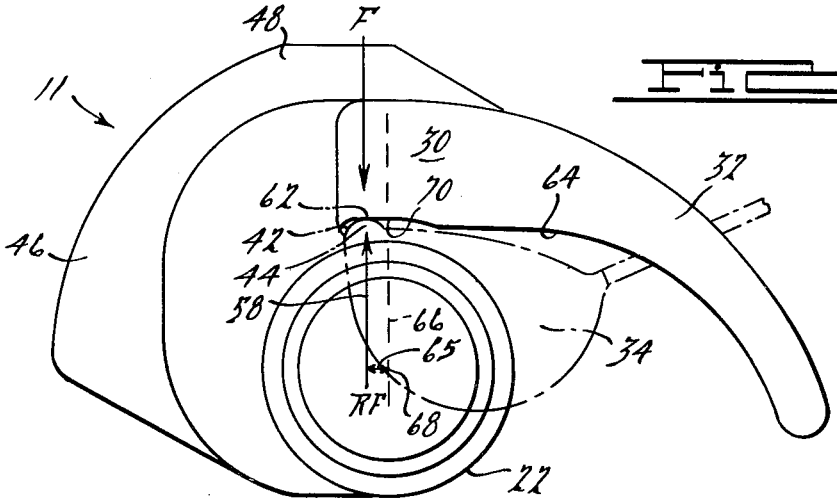
FIG. 6 is a fragmentary view of a hollow keeper housing in section and a camming finger in elevation illustrating the locking moment applied to the rotatable lock rod by force acting in a door opening direction.

The positive torque feature of the present invention can best be understood by referring to FIG. 6 which illustrates the moment of the line of action 58 of a reaction force RF resulting from force F directed outwardly on door 12 (not shown in FIG. 6). Camming finger 32 has a point of tangency 62 with camming surface 42 of keeper housing 34 at protuberance 44. The generally concave or inner surface 64 of camming finger 32 is substantially perpendicular to the direction of force F at the point of tangency so that the line of action 58 and force F are along the same line. As a result, the resulting torque or moment of force F on lock rod 22 is determined by the product of the magnitude of reaction force RF and the perpendicular distance 65 from line of action 58 to a plane 66 parallel thereto and passing through the axis of rotation 68 of camming member 30 and lock rod 22. Importantly, the direction of the moment is in a locking direction, clockwise in FIG. 6, because of the location of the point of tangency on the side of plane 66 opposite the end of camming finger 32 so that line of action 58 of force RF provides a moment tending to rotate camming member 30 in the direction pointed by camming finger 32. Inner surface 64 has a flat surface 70 extending a small distance on both sides of the point of tangency. A perpendicular distance 65 of about ⅛ inch is satisfactory, however, the exact measurements are not critical so long as the desired positive torque results.

Figure 7:
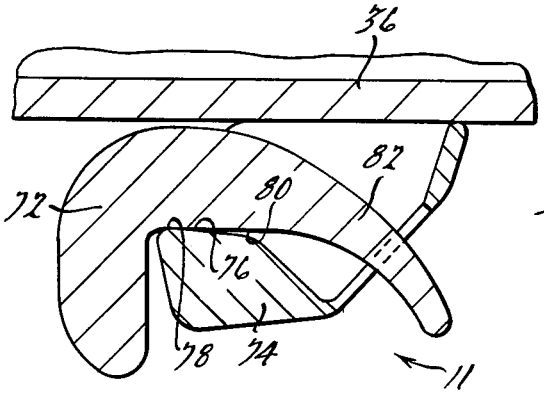
FIG. 7 is an enlarged broken sectional view similar to FIG. 2 but illustrating another embodiment of a hollow keeper housing and camming finger of the present invention.
Figure 4:
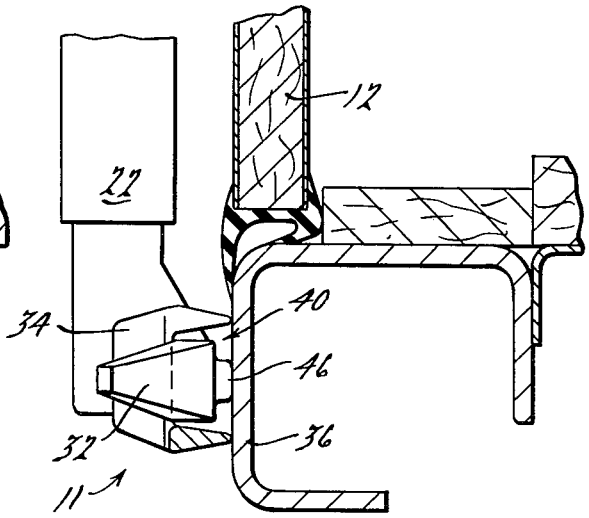
FIG. 4 is an enlarged broken sectional view taken along the line 4—4 of FIG. 1 and illustrating a hollow keeper housing and camming finger of this invention.

FIG. 7 illustrates another embodiment of the present invention employing a modified camming member 72 and keeper housing 74 which has no heel stop. In this embodiment, camming member 72, when in the closed position, is in substantially spanning relationship between camming surface 76 of keeper housing 74 and bottom sill 36 of trailer 10. While keeper housing 74 does not have a pronounced protuberance 44 as in the previously disclosed embodiment, camming surface 76 of keeper housing 74 has a point of tangency 78 with camming surface 80 of camming finger 82. As in the previously disclosed embodiment camming surface 80 is a substantially flat planar surface at and near the point of tangency and is furthermore substantially perpendicular to a plane passing through the axis of rotation of camming member 72, said latter plane being parallel to the line of force in a door opening direction.

It will, of course, be appreciated by those skilled in the art that while the above description has been cast in terms of the lower section of a door hinged on its left side, analagous door hardware would be used on the upper left section and further that analagous and symmetrical door hardware would be used on a door hinged on its right side.

It is to be understood that while a specific form of this invention has been described and illustrated herein, the present invention may be varied within the scope of the appended claims without departing from the spirit thereof.

What is claimed is:

1. A door for a shipping container comprising; a hinge pivotally supporting said door at one edge of an opening to said container, a cam rod supported for rotation on and relative to said door at an edge of the door opposite to the hinged edge thereof, a cam finger having a free end and a supported end mounted on one end of said rod, a housing secured to said container having a cam surface engagable by said cam finger for camming the door to a closed position, means for rotating said rod, and cam finger relative to said housing, said cam finger having a first substantially planar surface when said door is in the closed condition, the point of contact between the cam surface on said housing and said planar surface of said cam finger lying in a plane which is spaced to the opposite side of the axis of rotation of said cam rod from the projecting end of said finger, whereby the vector of the reaction force of said cam surface on said cam finger results in a moment on said rod in a latching direction due to an opening force on said door independent of movement of said cam rod and cam finger in a direction parallel to the plane of said door opening and relative to the cam surface on said housing.

2. A door as recited in claim 1 wherein said cam finger has a second generally planar surface spaced toward said end face of said container from said first generally planar surface, said planar surfaces being generally parallel, and an abutment for engaging said second planar surface when said first planar surface engages said cam surface on said housing, and whereby said first generally planar surface is held adjacent said cam surface on said housing with very little play therebetween.

3. A door as recited in claim 1 wherein the spacing of said plane containing said point of contact from the axis of rotation of said rod is at least ⅛ inch.

4. A door as recited in claim 1 wherein said inner surface has a relatively small protuberance thereon at said point of contact.

5. A hinged door for a cargo container having a door frame, said door having a rod rotatably supported on and extending beyond a free edge thereof at a position spaced from the hinged edge of the door; said rod extending parallel to the axis of rotation of said door, a camming finger fixedly secured to an end of said rod and extending laterally from the rod and rotatable therewith, a hollow keeper housing supported on the frame of said door and located at a position so as to be engagable by said camming finger, said keeper housing having an opening in an outer wall through which said camming finger is insertable and an inwardly facing camming surface which engages said camming finger for camming the door to a closed position, the point of engagement between said inwardly facing camming surface and said camming finger being on a substantially planar surface of said camming finger when said door is closed and said camming finger is rotated to the locked condition, said point of engagement providing a line of force spaced to the opposite side of the axis of rotation of said rod from the end of said camming finger whereby a moment is applied to said rod in a locking direction in response to an outward force on said door.

* * * * *